US005228298A

United States Patent [19]

Kun et al.

[11] Patent Number: 5,228,298

[45] Date of Patent: Jul. 20, 1993

[54] CRYOGENIC RECTIFICATION SYSTEM WITH HELICAL DRY SCREW EXPANDER

[75] Inventors: Leslie C. Kun; Neno T. Nenov, both of Williamsville, N.Y.

[73] Assignee: Praxair Technology, Inc., Danbury, Conn.

[21] Appl. No.: 868,869

[22] Filed: Apr. 16, 1992

[51] Int. Cl.[5] ..... F25D 25/00

[52] U.S. Cl. ..... 62/39; 418/104; 418/201.1

[58] Field of Search ..... 62/39; 418/201.1, 104

[56] References Cited

U.S. PATENT DOCUMENTS

| | | | |
|---|---|---|---|
| 3,073,513 | 1/1963 | Bailey | 418/201.1 |
| 3,507,577 | 4/1970 | Swearingen | 417/53 |
| 3,518,975 | 7/1970 | Schmidt | 123/8.49 |
| 3,825,311 | 7/1974 | Murray | 308/36.3 |
| 3,831,381 | 8/1974 | Swearingen | 60/657 |
| 4,086,072 | 4/1978 | Shaw | 62/2 |
| 4,185,465 | 1/1980 | Shaw | 60/678 |
| 4,193,603 | 3/1980 | Sood | 277/3 |
| 4,198,192 | 4/1980 | Webb | 417/373 |
| 4,209,998 | 7/1980 | Shaw | 62/324 |
| 4,384,725 | 5/1983 | Nenov | 277/3 |
| 4,430,011 | 2/1984 | Kun | 384/99 |
| 4,460,313 | 7/1984 | Austrem | 415/178 |
| 4,472,107 | 9/1984 | Chang et al. | 415/104 |
| 4,515,512 | 5/1985 | Hertell et al. | 418/104 |
| 4,733,536 | 3/1988 | DiBella et al. | 60/618 |
| 4,781,553 | 11/1988 | Nomura et al. | 418/201.1 |
| 4,872,893 | 10/1989 | Agrawal et al. | 62/39 |
| 4,904,158 | 2/1990 | Kun | 416/183 |
| 4,993,930 | 2/1991 | Uchida et al. | 418/104 |
| 5,046,199 | 9/1991 | Wulf | 415/1 |

*Primary Examiner*—Ronald C. Capossela
*Attorney, Agent, or Firm*—Stanley Ktorides

[57] ABSTRACT

An improved helical dry screw expander particularly suited for cryogenic service and its use in a cryogenic rectification system. The improved helical dry screw expander is particularly advantageous in a cryogenic waste expansion cycle particularly for nitrogen production.

3 Claims, 4 Drawing Sheets

CRYOGENIC RECTIFICATION SYSTEM WITH HELICAL DRY SCREW EXPANDER

TECHNICAL FIELD

This invention relates generally to cryogenic rectification and is particularly useful in the cryogenic rectification of feed air to produce nitrogen.

BACKGROUND ART

Industrial gases such as nitrogen and oxygen are produced commercially in large quantities by the cryogenic rectification of feed air. Refrigeration to drive the cryogenic rectification is provided by the turboexpansion of a compressed process stream which is generally either a compressed feed air stream or a high pressure waste stream taken from the rectification column. The turboexpander of an air separation plant is a costly piece of equipment to operate and maintain and it would be desirable to reduce such costs.

Helical screw compressors are inexpensive and durable. However, their use in reverse as expanders is not desirable because the oil flooded type would contaminate the process fluid and the independently geared non-lubricated rotor type is less efficient. Moreover, even the non-lubricated independently geared rotor type is susceptible to process fluid contamination from the bearing lubricant even though at high temperatures the rotor expansion would serve to improve efficiency. Still further, in cryogenic service the cold temperatures would freeze the lubricant and the rotor contraction would serve to further reduce efficiency.

It is an object of this invention to provide an improved helical dry screw expander which may be effectively employed in a cryogenic production cycle.

It is another object of this invention to identify a cryogenic production cycle which can effectively employ a helical dry screw expander without experiencing unexceptably high increased power costs.

SUMMARY OF THE INVENTION

The above and other objects which will become apparent to one skilled in the art upon a reading of this disclosure are attained by the present invention which in general comprises an improved non-oil-flooded or independently geared helical dry screw expander adapted to maintain the process fluid free from contamination and suitable for cryogenic service. The invention further comprises the recognition that the relatively inefficient independently geared helical dry screw expander may be particularly effectively employed in a particular cryogenic production cycle, the waste expansion cycle, with no added power cost and with some further modifications may also be effectively employed in an air expansion cycle.

In particular, one aspect of the invention is:

A cryogenic rectification plant for producing product comprising:

(A) a rectification column system, a main heat exchanger, and a helical dry screw expander;

(B) means for passing feed to the main heat exchanger and from the main heat exchanger to the rectification column system;

(C) means for passing waste fluid from the rectification column system to the helical dry screw expander and from the helical dry screw expander to the main heat exchanger;

(D) means for withdrawing waste fluid from the main heat exchanger; and (E) means for recovering product from the cryogenic rectification plant.

Another aspect of the invention is:

A method for producing product by the cryogenic rectification of feed air comprising:

(A) cooling feed air and passing the cooled feed air into a rectification column system;

(B) separating the feed air by cryogenic rectification in the rectification column system into product fluid and into waste fluid;

(C) withdrawing waste fluid from the rectification column system and expanding the withdrawn waste fluid by passing it through a helical dry screw expander to generate refrigeration;

(D) passing the expanded waste fluid in indirect heat exchange with feed air to carry out the cooling of step (A); and (E) recovering product from the rectification column system.

A further aspect of the invention is:

A cryogenic rectification plant for producing product comprising:

(A) a rectification column system, a main heat exchanger, and a feed compressor;

(B) means for passing feed from the feed compressor to the main heat exchanger and from the main heat exchanger to a helical dry screw expander;

(C) means for passing feed from the helical dry screw expander to the rectification column system; and (D) means for recovering product from the cryogenic rectification plant.

A further aspect of the invention is:

A method for producing product by the cryogenic rectification of feed air comprising:

(A) compressing and cooling feed air and passing the compressed feed air to a helical dry screw expander;

(B) expanding the compressed feed air by passing it through the helical dry screw expander to generate refrigeration;

(C) separating the feed air by cryogenic rectification in the rectification column system into product fluid and waste fluid; and (D) recovering product from the rectification column system.

A further aspect of the invention is:

A helical dry screw expander comprising:

(A) a helical screw rotor mounted on a shaft, said rotor housed in a casing having a process fluid inlet and a process fluid outlet, said shaft extending through the casing and outside the casing;

(B) a bearing on the shaft spaced from the casing and means for providing lubricant to the bearing and from the bearing;

(C) a seal system around the shaft between the bearing and the casing; and (D) means for providing sealing gas to the seal system proximate the casing, and means for withdrawing sealing gas from the seal system proximate the bearing, thereby keeping process fluid from migrating out of the casing along the shaft and keeping lubricant from migrating into the casing along the shaft.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150 degrees K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "waste fluid" means any fluid taken from the cryogenic rectification column system other than the product fluid. The waste fluid may be recovered or released to the atmosphere.

As used herein, the term "compressor" means a device for increasing the pressure of a gas.

As used herein, the term "expander" means a device used for extracting work out of a compressed gas by decreasing its pressure.

As used herein, the term "helical screw expander" means an expander comprising two intermeshing geared rotors, male and female, equipped with helical grooves or lobes. Gas, trapped in the voids created between the intermeshing lobes and the casing, expands causing the rotors to rotate thereby extracting work from the gas and transferring it to the rotors.

As used herein the term "helical dry screw expander" means a helical screw expander free of oil or any other lubricant present in the working chamber or casing of the machine.

As used herein, the term "top condenser" means a heat exchange device which generates column downflow liquid from column top vapor.

As used herein, the term "rectification column system" means an apparatus comprising a column and optionally comprising a top condenser.

DETAILED DESCRIPTION

The invention will be described in detail with reference to the Drawings.

Figure 1:
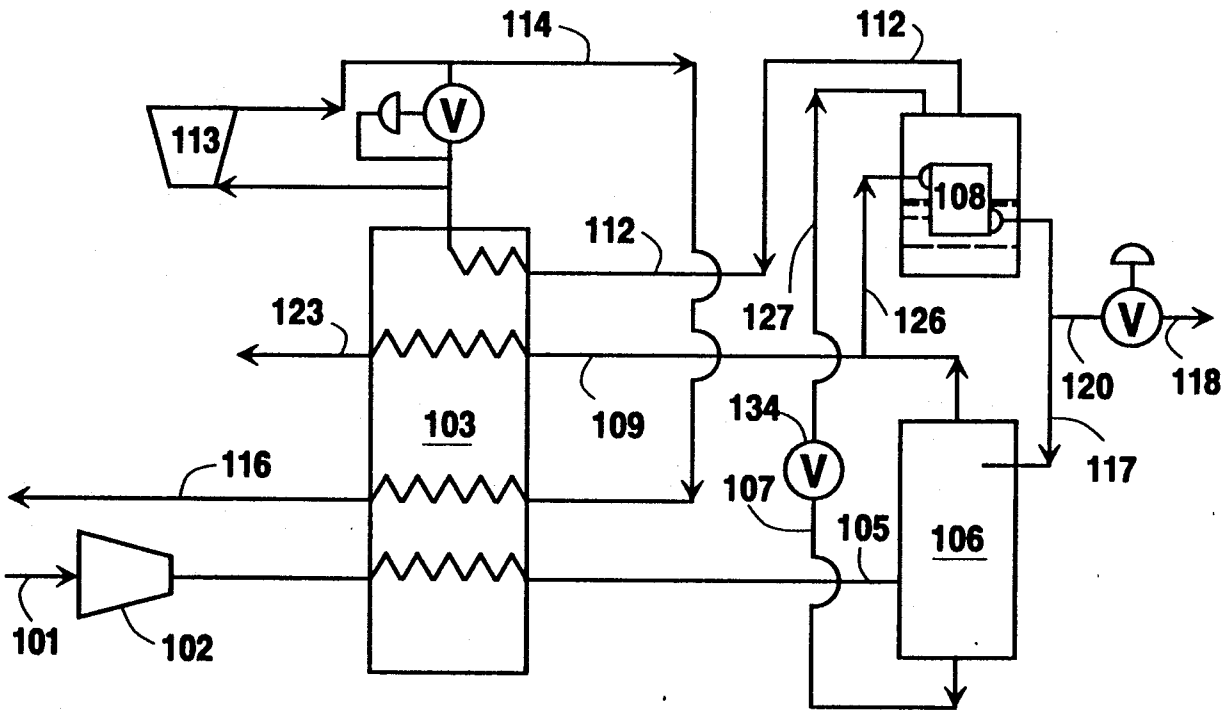
FIG. 1 is a simplified schematic flow diagram of one embodiment of a waste expansion cryogenic nitrogen production cycle wherein the improved helical dry screw expander of the invention may be advantageously employed.

FIG. 1 represents one particular embodiment of a waste expansion cryogenic nitrogen production system and is presented for illustrative purposes. The invention may be employed with any suitable cryogenic rectification plant. It is particularly useful in a waste expansion cryogenic nitrogen production cycle wherein a waste stream from a rectification column is expanded to generate refrigeration and the expanded waste stream is passed in indirect heat exchange with incoming feed air to cool the feed air and thus provide refrigeration into the rectification column system to drive the rectification.

Referring now to FIG. 1, feed air 101 is compressed in base load feed air compressor 102 and then passed through main heat exchanger 103. Within main heat exchanger 103 the compressed feed air is cooled by indirect heat exchange with expanded waste fluid as will be discussed in greater detail later. The compressed and cooled feed air, which is also cleaned of high boiling impurities such as water vapor and carbon dioxide, is then passed as stream 105 into a cryogenic rectification column system.

The cryogenic rectification column system illustrated in FIG. 1 comprises a single column 106 and a top condenser 108. It is preferred in the practice of this invention that the cryogenic rectification plant comprise one column although plants comprising more than one column may be employed. Column 106 preferably is operating at a pressure within the range of from 40 to 140 pounds per square inch absolute (psia).

Within column 106 the feed air is separated by cryogenic rectification into product nitrogen vapor and a nitrogen-containing liquid. The product nitrogen vapor is withdrawn from the upper portion of column 106 generally having a purity in the range of 98 percent nitrogen to 99.9999 percent nitrogen or greater. A portion 126 of product nitrogen vapor 109 is passed into top condenser 108 wherein it is condensed against nitrogen-containing liquid and then passed as stream 117 back into column 106 as reflux. If desired, a portion 120 of stream 117 may be recovered as product liquid nitrogen 118. Nitrogen-containing liquid, having a nitrogen concentration generally within the range of from 60 to 70 percent, is removed from the lower portion of column 106 as stream 107, reduced in pressure through valve 134, and passed as stream 127 into top condenser 108 wherein it boils to carry out the condensation of stream 126.

The withdrawn product nitrogen vapor 109 is warmed by passage through main heat exchanger 103 in indirect heat exchange with feed air thereby cooling the feed air. Thereafter, the warmed product nitrogen 123 is recovered. If desired, the warmed product nitrogen may be compressed by passage through a compressor and resulting high pressure product nitrogen may then be recovered.

Nitrogen-containing waste fluid is withdrawn from top condenser 108 of the rectification column system as stream 112 which then partially traverses main heat exchanger 103 and is then expanded through helical dry screw expander 113 to a pressure within the range of from 20 psia to atmospheric pressure. Helical dry screw expander 113 may be coupled to a nitrogen product compressor if it is used. In such a directly coupled expander-compressor system, both devices are connected mechanically with or without a gear system so that the energy extracted from the expanding gas stream is passed directly by the helical drive screw expander via the compressor to the compressed product nitrogen gas. This arrangement minimizes both extraneous losses and capital expenditures associated with an indirect energy transfer from the expander to the compressor via an intermediate step of, for example, electric generation. As waste fluid 112 passes through helical dry screw expander 113, it drives the helical dry screw expander which then drives the compressor serving to carry out the compression of the product nitrogen. Simultaneously, the expanding waste fluid is cooled by passage through helical dry screw expander 113.

Cooled, expanded waste fluid 114 is then warmed by passage through main heat exchanger 103 in indirect heat exchange with feed air to carry out cooling of the feed air thus providing refrigeration into the cryogenic rectification column system with the feed air to drive or carry out the cryogenic rectification. The resulting warmed waste fluid is removed from main heat exchanger 103 as stream 116.

Figure 2:
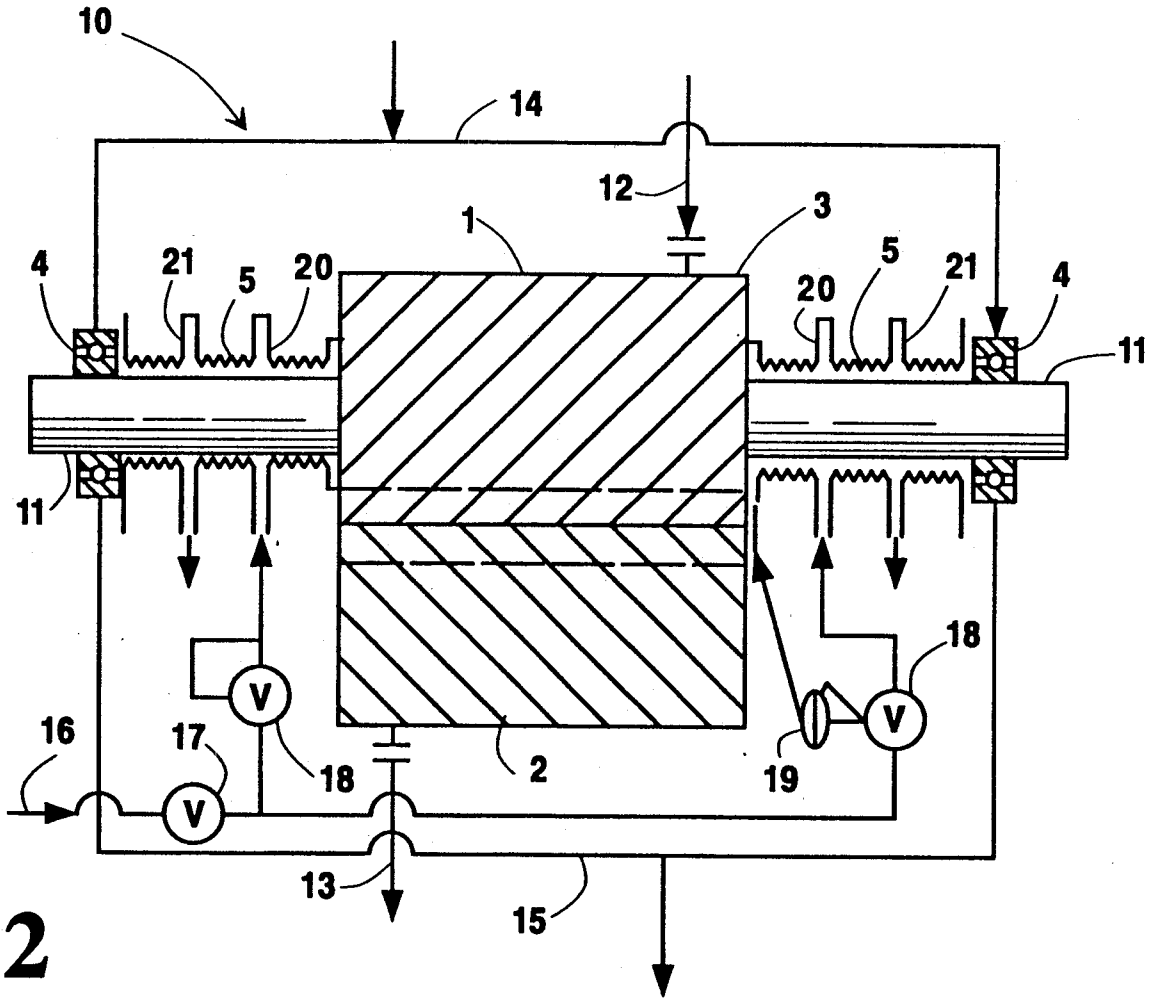
FIG. 2 is a cross-sectional representation showing details of the improved helical dry screw expander of the invention which enable its effective employment within a cryogenic rectification plant.

FIG. 2 is a cross-sectional view of the details of the helical dry screw expander of this invention which enable its effective use in a cryogenic rectification plant or air separation cycle. Referring now to FIG. 2, helical dry screw expander 10 comprises a helical screw rotor 1 mounted on a shaft 11. The helical screw rotor is housed completely within casing 3 and shaft 11 extends through casing 3 and extends outside casing 3 on either side of the casing.

A helical screw machine contains two rotors within the casing. The second rotor is shown as 2 in FIG. 2. In actual practice helical screw rotor 2 is also mounted on a shaft and has all the other details associated with its shaft as will be described with reference to shaft 11. The details associated with helical screw rotor 2 are not shown for purposes of clarity since they are identical to the details associated with helical screw rotor 1.

Process fluid such as waste fluid or feed air is passed into casing 3 through process fluid inlet 12 and out from casing 3 through process fluid outlet 13. In the process, the process fluid expands generating refrigeration and driving the rotors. In a conventional helical screw machine only one of the rotors is driven and it engages the other rotor for rotation. In this conventional situation, the casing is flooded with oil to prevent rotor damage. However, in the situation where the process fluid is associated with a cryogenic air separation plant, the casing must be free of oil because the cryogenic temperatures will cause the lubricant to freeze up. Therefore gears installed at one protruding end of the shafts are utilized to keep the two rotors in proper angular relationship. Generally, the efficiency of the separately geared, non-oil-flooded helical dry screw expander of this invention will not exceed 80 percent, and generally will be within the range of from 30 to 70 percent.

Bearings 4 are on shaft 11 spaced from casing 3 on either side of the casing. Lubricant such as oil is provided to the bearings through line 14 and withdrawn from the bearings through line 15. Bearing lubricant will typically tend to migrate into the casing along the shaft. In a conventional oil flooded arrangement this would not create a problem. However, in cryogenic service this would cause freezing problems such as was previously described. The helical dry screw expander of this invention is especially adapted for cryogenic service to counteract the lubricant migration.

Around shaft 11 between bearing 4 and casing 3 there is seal system 5. A seal system is any device which will contain sealing gas around the shaft. The seal system may be any effective seal system such as seal rings, labyrinths or a grooved bushing such as is illustrated in FIG. 2. The seal system creates a series of localized pressure buildups along the shaft countering the flow of lubricant along shaft 11 from bearing 4 to casing 3.

Sealing gas is provided to the seal system. The sealing gas is preferably the same as the process fluid, e.g. waste nitrogen or feed air. In the arrangement illustrated in FIG. 2 the sealing gas, which is at a warm temperature typically within the range of from 40° F. to 150° F., is passed in line 16 through valve 17 and then to bushing 5 through valve 18. As is appreciated by one skilled in the art, the arrangement illustrated in FIG. 2 shows both sides of the sealing gas system. Regulator 19 senses the pressure near the casing and controls valve 18 to regulate the sealing gas flow. Regulator 19 is shown on only one of the valves 18.

The sealing gas is provided to the seal system between the casing and the bearing proximate the casing. By "proximate the casing" it is meant nearer to the casing than to the bearing. The seal gas is withdrawn from the seal system proximate the bearing. By "proximate the bearing" it is meant nearer to the bearing than to the casing. In this way, the sealing gas flows along shaft 11 between shaft 11 and seal system 5 in a direction away from casing 3 and toward bearing 4 thus serving, in conjunction with the aforesaid series of localized pressure buildups, to further counteract the migration of lubricant from bearing 4 into casing 3. Thus casing 3 is completely free of lubricant. The sealing gas also serves to keep the process fluid within the casing. The embodiment illustrated in FIG. 2 is a preferred embodiment wherein sealing gas is provided to bushing 5 through input header 20 and withdrawn from bushing 5 through output header 21. Both of these headers extend around bushing 5.

The warm temperature of the sealing gas also serves to keep any lubricant which may be on the shaft from freezing due to the cryogenic temperature of the process fluid. Some warm sealing gas will flow into casing 3. This will cause an efficiency loss as it mixes with the cold process fluid. However, this efficiency loss is tolerable in the overall application of the invention.

As indicated, a helical screw expander is a rugged machine with low maintenance costs but, especially in the separately geared version, has a low operating efficiency especially at cold temperatures. Moreover, certain innovations which enable the invention to operate under cryogenic conditions further reduce the efficiency. However, in a particular cryogenic production cycle, i.e. the waste expansion cycle, this low efficiency is not disadvantageous. The invention comprises the recognition that a helical dry screw expander, which has not heretofore been considered for cryogenic applications because of its low efficiency, fits surprisingly well into a cryogenic waste expansion production cycle. Thus one can get the benefits of low machine and maintenance costs without added power cost in this specific cryogenic cycle.

Figure 3:
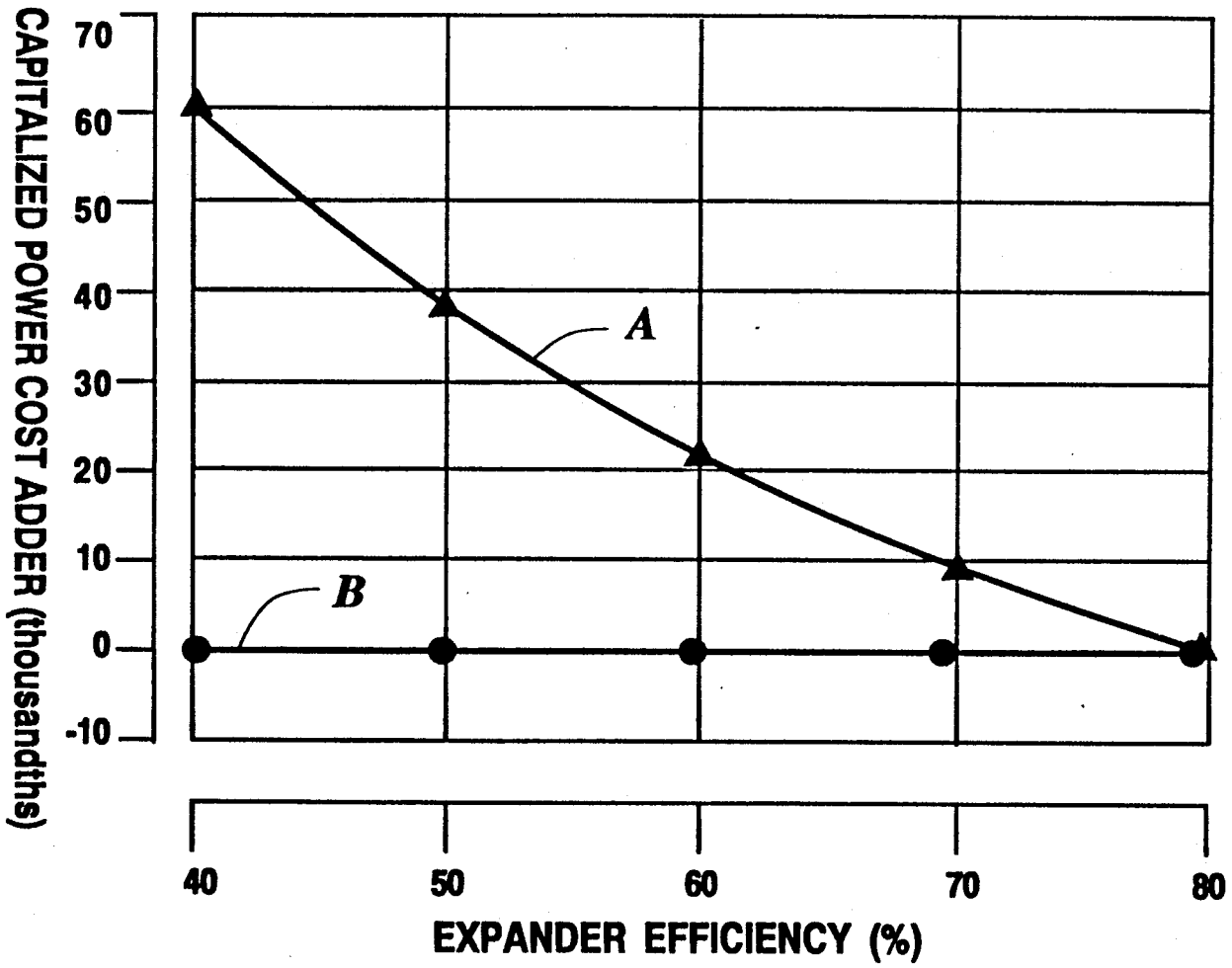
FIG. 3 is a graphical representation demonstrating the particular advantages of the independently geared helical dry screw expander of the invention when combined with a waste expansion cycle and also shows advantages when combined with a feed expansion cycle.

FIG. 3 graphically illustrates this serendipitous situation for a nitrogen production plant of 40 tons per day capacity. In FIG. 3, the horizontal axis denotes expander efficiency in percent and the vertical axis denotes the added capitalized expander cost in thousands of dollars at a capitalized power cost of fifteen hundred dollars per kilowatt.

Curve A with the triangular data points is for an air expansion cycle and Curve B with the circular data points is for a waste expansion cycle. As can be seen, in the air expansion cycle, there is a sharp increase in capitalized cost as the expander efficiency drops from 80 to 40 percent. However, for the waste expansion cycle, there is no added capitalized cost even at an expander efficiency as low as 40 percent.

The difference between the waste expansion and the air expansion cycle is because the rectification column pressure in a waste expansion process cannot be reduced below a certain minimum level relating to the pressure level of the delivered product gas stream. A waste expansion plant has a lower first capital cost but has a higher unit power cost because excess energy is wasted via, e.g. expander flow bypass. Hence, with such an excess of available energy, an expander with as low as 40 percent efficiency will still provide enough refrigeration for the separation process.

However, the helical dry screw expander of this invention may also be effectively employed in an air expansion cycle such as an air expansion nitrogen production cycle by insulating the casing and the bearings to raise the expander efficiency to about 60 percent or more. The added power cost at an increased efficiency resulting from the aforesaid insulation will not exceed the initial lower cost of such a machine over that of a conventional expander and thus the invention is also advantageously employed in an air expansion cycle.

Figure 4:
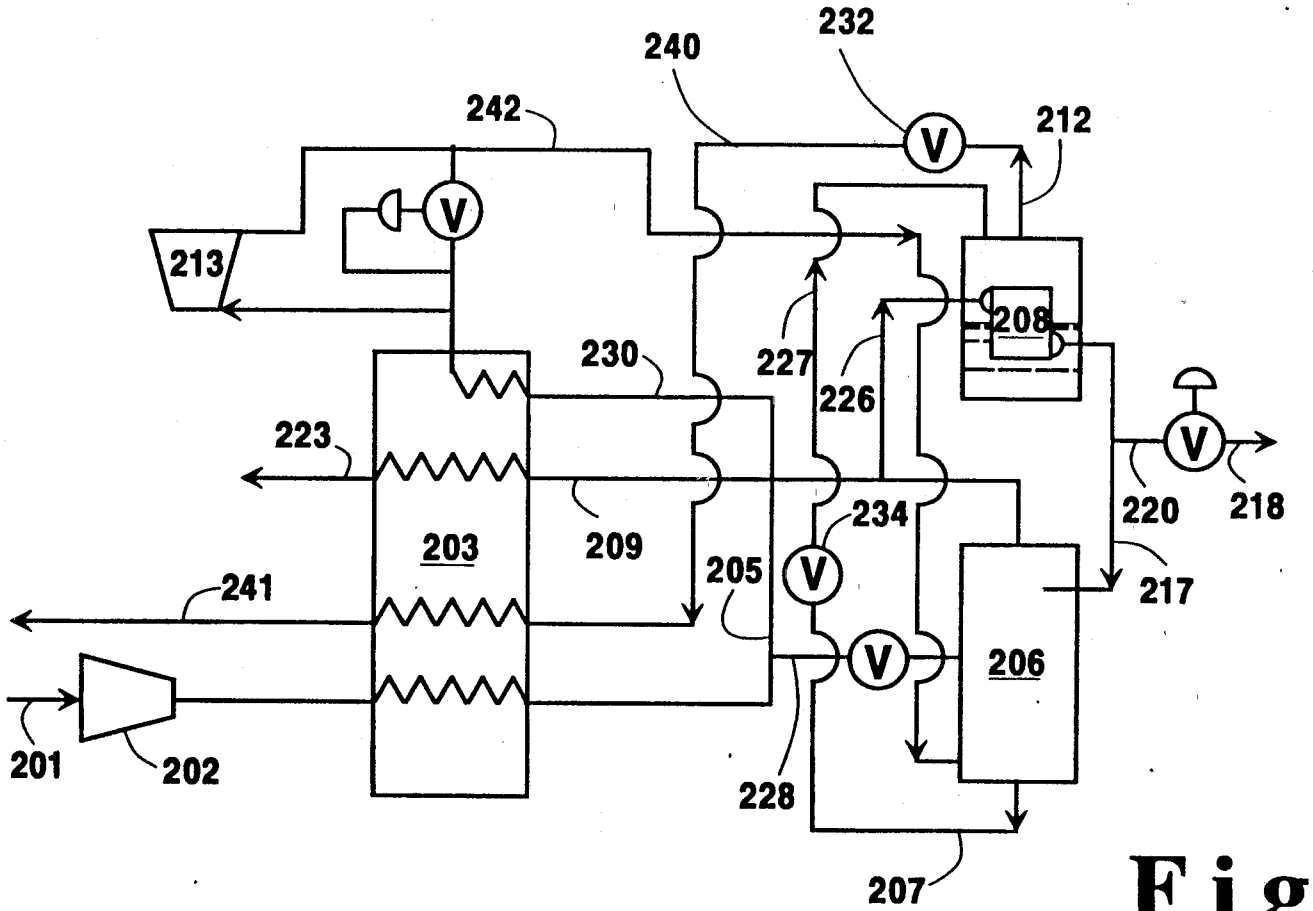
FIG. 4 is a simplified schematic flow diagram of one embodiment of a feed air expansion cryogenic nitrogen production cycle wherein the improved helical dry screw expander of the invention may be advantageously employed.

Such an air expansion cycle is illustrated in FIG. 4. The numerals in FIG. 4 correspond to those of FIG. 1 plus 100 for the elements common to both and these common elements will not be discussed again in detail.

Referring now to FIG. 4, waste fluid stream 212 is withdrawn from top condenser 208, reduced in pressure through valve 232 and resulting stream 240 is warmed by passage through main heat exchanger 203 in indirect heat exchange with compressed feed air and then removed from the system as stream 241. Cooled, compressed feed air 205 is passed at least in part through helical dry screw expander 213. In the embodiment illustrated in FIG. 4, a portion 228 of the cooled compressed feed air is passed directly into column 206 and another portion 230 partially traverses main heat exchanger 203 and is then expanded through helical dry screw expander 213. The portion of the cooled, compressed feed air which is expanded through helical dry screw expander 213 may be within the range of from 90 to 100 percent of the cooled, compressed feed air. In the case where 100 percent of the cooled, compressed feed air is passed through helical dry expander 213, stream 228, as illustrated in FIG. 4, would not be present.

As the feed air passes through expander 213, it drives the expander which then may drive a compressor to compress product nitrogen. Simultaneously, the expanding feed air is cooled by passage through helical dry screw expander 213.

Cooled, expanded feed air 242 is then passed from helical dry screw expander 213 into column 206 of the cryogenic rectification plant thus providing refrigeration into the cryogenic rectification plant to drive or carry out the cryogenic rectification.

Now by the use of the improved helical dry screw expander of the invention, one can produce nitrogen or oxygen employing cryogenic rectification with lower machine costs without experiencing a high cost penalty due to low efficiency. Although the invention has been described in detail with reference to a specific embodiment, those skilled in the art will recognize that there are other embodiments of the invention within the spirit and scope of the claims.

We claim:

1. A cryogenic rectification plant for producing product comprising:

(A) a rectification column system, a main heat exchanger, and a helical dry screw expander;

(B) means for passing feed to the main heat exchanger and from the main heat exchanger to the rectification column system;

(C) means for passing waste fluid from the rectification column system to the helical dry screw expander and from the helical dry screw expander to the main heat exchanger;

(C) means for withdrawing waste fluid from the main heat exchanger; and (E) means for recovering product from the cryogenic rectification plant; wherein the helical dry screw expander comprises:

(F) a helical screw rotor mounted on a shaft, said rotor housed in a casing having a process fluid inlet and a process fluid outlet, said shaft extending through the casing and outside the casing;

(G) a bearing on the shaft spaced from the casing and means for providing lubricant to the bearing and from the bearing;

(H) a seal system around the shaft between the bearing and the casing; and (I) means for providing sealing gas to the seal system proximate the casing, and means for withdrawing sealing gas from the seal system proximate the bearing, thereby keeping process fluid from migrating out of the casing along the shaft and keeping lubricant from migrating into the casing along the shaft.

2. A method for producing product by the cryogenic rectification of feed air comprising;

(A) cooling feed air and passing the cooled feed air into a rectification column system;

(B) separating the feed air by cryogenic rectification in the rectification column system into product fluid and into waste fluid;

(C) withdrawing waste fluid from the rectification column system and expanding the withdrawn waste fluid by passing it through a helical dry screw expander to generate refrigeration;

(D) passing the expanded waste fluid in indirect heat exchange with feed air to carry out the cooling of step (A); and (E) recovering product form the rectification column system; wherein the helical dry screw expander comprises:

(F) a helical screw rotor mounted on a shaft, said rotor housed in a casing having a process fluid inlet and a process fluid outlet, said shaft extending through the casing and outside the casing;

(G) a bearing on the shaft spaced from the casing and means for providing lubricant to the bearing and from the bearing;

(H) a seal system around the shaft between the bearing and the casing; and (I) means for providing sealing gas to the seal system proximate the casing, and means for withdrawing sealing gas from the seal system proximate the bearing, thereby keeping process fluid from migrating out of the casing along the shaft and keeping lubricant from migrating into the casing along the shaft.

3. The method of claim 2 wherein the product is nitrogen.

* * * * *

UNITED STATES PATENT AND TRADEMARK OFFICE

CERTIFICATE OF CORRECTION

PATENT NO. : 5,228,298

DATED : July 20, 1993

INVENTOR(S) : L. C. Kun et al

It is certified that error appears in the above-indentified patent and that said Letters Patent is hereby corrected as shown below:

Column 9, claim 2, line 12, delete "form" and insert therefor --from--

Signed and Sealed this

Eighth Day of February, 1994

Bruce Lehman

*Attest:*

BRUCE LEHMAN

*Attesting Officer*

*Commissioner of Patents and Trademarks*